US006925774B2

(12) United States Patent
Peterson

(10) Patent No.: US 6,925,774 B2
(45) Date of Patent: Aug. 9, 2005

(54) COMPACT STRUCTURE FOR AUTOMATICALLY FILLING SOLID PHARMACEUTICAL PRODUCT PACKAGES

(75) Inventor: Raymond Peterson, Clearwater, FL (US)

(73) Assignee: MTS Medication Technologies, Inc., Clearwater, FL (US)

( * ) Notice: Subject to any disclaimer, the term of this patent is extended or adjusted under 35 U.S.C. 154(b) by 0 days.

(21) Appl. No.: 10/439,051

(22) Filed: May 14, 2003

(65) Prior Publication Data

US 2004/0000354 A1 Jan. 1, 2004

Related U.S. Application Data

(63) Continuation-in-part of application No. 09/704,134, filed on Nov. 11, 2000, which is a continuation-in-part of application No. 09/539,834, filed on Mar. 31, 2000.

(51) Int. Cl.[7] ..... B65B 35/30

(52) U.S. Cl. ..... 53/152; 53/539; 53/240; 53/247; 53/250

(58) Field of Search ..... 53/509, 52, 131.2, 53/150, 152, 153, 156, 534, 539, 247, 237, 240, 154, 531, 543, 250

(56) References Cited

U.S. PATENT DOCUMENTS 3,456,424 A * 7/1969 Thurston et al. ..... 53/154
4,870,799 A * 10/1989 Bergerioux et al. ..... 53/55
5,720,154 A * 2/1998 Lasher et al. ..... 53/411

* cited by examiner

*Primary Examiner*—John Paradiso
(74) *Attorney, Agent, or Firm*—Robert J. Depke

(57) ABSTRACT

An automated solid pharmaceutical product packaging machine includes a plurality of temporary storage members for receiving a plurality of solid pharmaceutical products in a plurality of cavities. The use of the temporary storage cavities enables the machine to process several prescriptions simultaneously. Advantageously, at least one of the temporary storage members is capable of being automatically displaced in a vertical direction in order to increase the capacity of the overall filling system for processing a greater number of solid pharmaceutical products while minimizing the overall footprint of the device.

2 Claims, 6 Drawing Sheets

COMPACT STRUCTURE FOR AUTOMATICALLY FILLING SOLID PHARMACEUTICAL PRODUCT PACKAGES

RELATED APPLICATIONS

This application is a Continuation-In-Part of application Ser. No. 09/704,134, filed Nov. 11, 2000, which is itself a Continuation-In-Part of application Ser. No. 09/539,834, filed Mar. 31, 2000.

BACKGROUND OF THE INVENTION

1. Field of the Invention

The present invention relates generally to the field of automated solid pharmaceutical product packaging devices. More specifically, the present invention is directed to automated solid pharmaceutical product packaging devices for filling blister packages which are capable of handling a larger variety of pharmaceutical products in a compact structure.

2. Description of the Related Art

Solid pharmaceutical product packaging devices are well-known and exist in a variety of different formats. One well-known variety of these machines is suitable for filling blister package products. In this previous approach, a plurality of automatic dispensing canisters are secured in a common cabinet and these dispensing canisters are connected via a computer which controls the selective dispensation of the solid pharmaceutical members contained within the canisters. Once the solid pharmaceuticals have been ejected from a given canister, the solid pharmaceutical products fall away from the canisters and are directed into a funnel member that specifically locates the selectively dispensed product or products into a cavity which may be subsequently aligned with corresponding cavities in blister packages.

One shortcoming of these known devices is that users typically require that the machine fits into a room with standard ceilings that may only by eight feet high. In order to accommodate a wide variety of pharmaceuticals for automatically filling solid pharmaceutical packages, however, it is necessary that the cabinet within which the automated dispensation canisters are located have a significant height. This is at least in part due to the fact that gravity is used to move the solid pharmaceutical products after they have been ejected from the canisters. Consequently it is more difficult to achieve horizontal displacement of the products into a desired location. As a result, the machines for dispensing the products and filling the blister packages may be placed at a level that is undesirable because it is preferable to have the canisters physically located above the location into which the solid pharmaceutical products are dropped.

Another design constraint is the fact that it is preferable to minimize the overall footprint of the packaging machinery. Hospitals and/or other managed care facilities that typically utilize these devices do not usually have a substantial amount of additional space available for the machinery. Consequently, in light of these concerns and requirements, the existing machinery has been unsatisfactory. Accordingly, there remains a need in the art for improved solid pharmaceutical packaging devices that are capable of automatically filling solid pharmaceutical product packages and which may also accommodate a large library of different products while also minimizing the space within which the device is located.

One object and advantage of the present invention is to provide a solid pharmaceutical product packaging machine that is capable of providing a wide variety of solid pharmaceutical sources. Another object and advantage of the present invention is to provide a solid pharmaceutical product packaging machine that is more efficient in terms of its physical size than devices of the prior art. Other objects and advantages will be apparent in light of the following Summary and detailed Description of the Presently Preferred Embodiments.

SUMMARY OF THE INVENTION

In accordance with a preferred exemplary embodiment of the present invention, a solid pharmaceutical product packaging machine automatically fills blister package cavities with one or more individual doses of one or more solid pharmaceutical products. Advantageously, the cavity dispensing cabinet may be a significant height and almost as high as the height of a typical room which usually has eight foot ceilings. The cabinet is sized in this manner so that a larger variety solid pharmaceutical products may be accommodated in individual automated dispensing cam canisters contained within the cabinet or dispensing portion. In a particularly preferred exemplary embodiment, the cabinet member may be modularly expandable depending upon the particular needs of the facility using this machine.

The individual dispensing canisters are preferably controlled by a computer, such as, for example, a personal computer that is programmed to selectively dispense solid pharmaceutical products according to a patient prescription. In accordance with the preferred embodiment, solid pharmaceutical products are selectively ejected from the individual canisters and are directed into a funnel that transmits the individual solid pharmaceutical products into select cavities of a temporary storage member. Advantageously, this temporary storage member is located in a structure that is capable of selectively manipulating the position of the individual cavities of the temporary storage member beneath the funnel. This enables the device to selectively dispense one or more solid pharmaceutical products into a given cavity of the temporary storage member.

Conventional designs of similar systems which rely upon the canister dispensing technology described herein are exemplified by co-pending U.S. patent application Ser. No. 09/704,134 titled Automated Solid Pharmaceutical Product Packaging Machine filed on Nov. 1, 2000 and Ser. No. 09/539,834 titled Automated Solid Pharmaceutical Product Packaging Machine filed Mar. 31, 2000. Each of these co-pending United States patent applications are incorporated herein by reference.

In accordance with a preferred exemplary embodiment, the structure that is capable of selectively manipulating the position of the temporary storage member is located very near to the floor of the facility within which the system is operated. This desirably enables a substantial number of solid pharmaceutical products to be dispensed by the device. Subsequent operational aspects of the machine ensure that the physical location of the temporary storage member is not a hindrance to the overall performance characteristics of the machine and the ease with which it may be operated by a user.

In accordance with the preferred exemplary embodiment, once the temporary storage member has been filled with the desired number of solid pharmaceutical products by the dispensing apparatus, the solid pharmaceutical members are transferred into a further temporary storage member that traverses in the horizontal directions away from the initial temporary storage member. This enables high-speed operation of the device because the system may be used to selectively fill another patient prescription while the initial prescription is being further processed by the system.

After the further temporary storage member traverses away from the initial temporary storage member, it is subsequently aligned with a vertically displaceable temporary storage device or member. Each of the temporary storage devices or members preferably has a plurality of cavities located therein that correspond to the cavities in a blister package to be filled with the solid pharmaceutical products. The vertically displaceable temporary storage member is used to transfer the solid pharmaceutical products into a location that is directly above the blister package positioning member. By sliding the bottom portion of the vertically displaceable temporary storage member, a user is able to fill a plurality of blister package cavities at a convenient height for the user so that is much easier for the user to ensure that the cavities have been appropriately filled with the desired solid pharmaceutical products.

This portion of the overall operation may take place while one or more of the remaining temporary storage members are being filled with other solid pharmaceutical products thereby enabling high-speed operation of the system.

DETAILED DESCRIPTION OF THE PRESENTLY PREFERRED EMBODIMENTS

Figure 1:
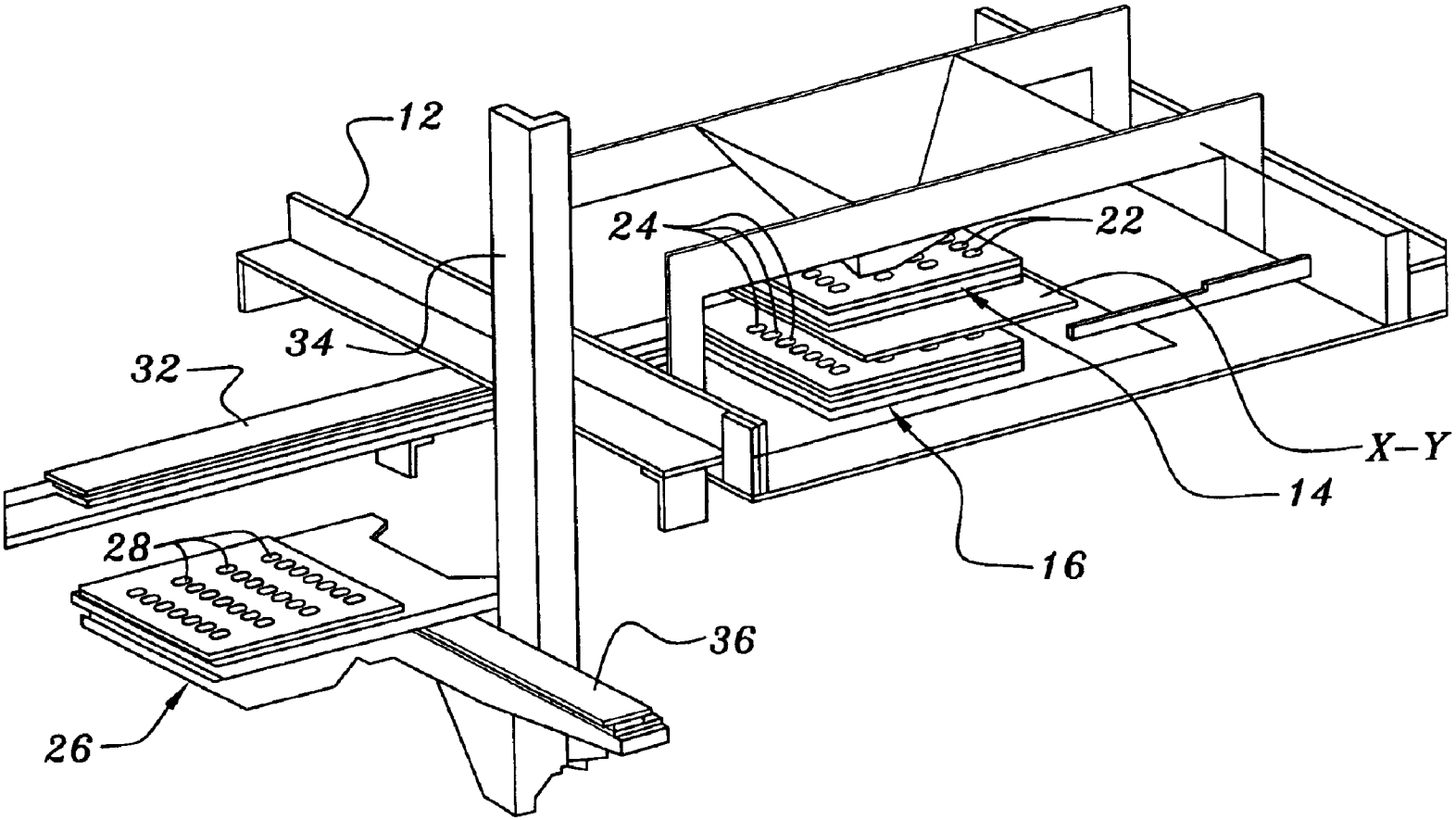
FIG. 1 illustrates a first preferred exemplary embodiment of the present invention.

FIG. 1 illustrates a first preferred exemplary embodiment of the present invention which is shown generally at 10. As illustrated in FIG. 1, a support framework 12 provides a mechanical support for receiving and/or supporting a structure that includes a temporary storage member 14 that is movable in at least 2 axis of displacement. The tray or initial temporary storage member 14 is preferably comprised of a plurality of solid pharmaceutical product cavities arranged in a matrix that corresponds to the arrangement of blister package cavities of a package to be filled. The tray or initial temporary storage member is also known as the upper temporary storage member and is displaced in xy coordinates to selectively locate individual ones of the cavity members beneath a funnel that receives solid pharmaceutical product members that are deposited from a dispensing device or canister.

A plurality of solid pharmaceutical product dispensers or canisters are arrayed in a cabinet. As is known in the art, the individual canisters are automatically controlled to selectively dispense desired pharmaceutical products into the cavities beneath the end of the funnel member. These techniques are well-known in the art. Conventional designs of similar systems which rely upon the canister dispensing technology described herein are exemplified by co-pending U.S. patent application Ser. No. 09/704,134 titled Automated Solid Pharmaceutical Product Packaging Machine filed on Nov. 1, 2000 and Ser. No. 09/539,834 titled Automated Solid Pharmaceutical Product Packaging Machine filed Mar. 31, 2000. Each of these co-pending United States patent applications are incorporated herein by reference. Accordingly, the instant application does not directly describe the arrangement of the canisters and the funnel. One significant difference between the present application and the above referenced earlier filed applications is that the present application provides significantly greater versatility in enabling a greater number of products to be used with the system while also minimizing the overall footprint of the device.

A further temporary receiving tray or member 16 is also known as the lower temporary receiving member and is selectively positioned beneath the initial or upper temporary receiving member 14 so that solid pharmaceutical products may be dropped into the lower receiving tray as a temporary storage member for storing the pharmaceutical products that have been selectively deposited into the initial receiving tray or member 14. This is accomplished by providing proper registration between the individual cavities 22, 24 respectively of the upper and lower temporary receiving members 14, 16. Thereafter, the lower temporary storage member is traversed from beneath the initial storage member 14 so that this temporary storage member may be located above a further temporary storage member 26 that is movable in a vertical direction. This advantageously allows the initial receiving member 14 to be located at a significantly lower level while thereafter enabling simultaneously filling of the initial receiving member to occur while the further processing of the initially processed solid pharmaceutical members is performed. The lower physical location of this device enables a significantly greater number of canisters to be placed in the dispensing unit thereby allowing the overall device to access a significantly greater number of solid pharmaceutical products.

Figure 2:
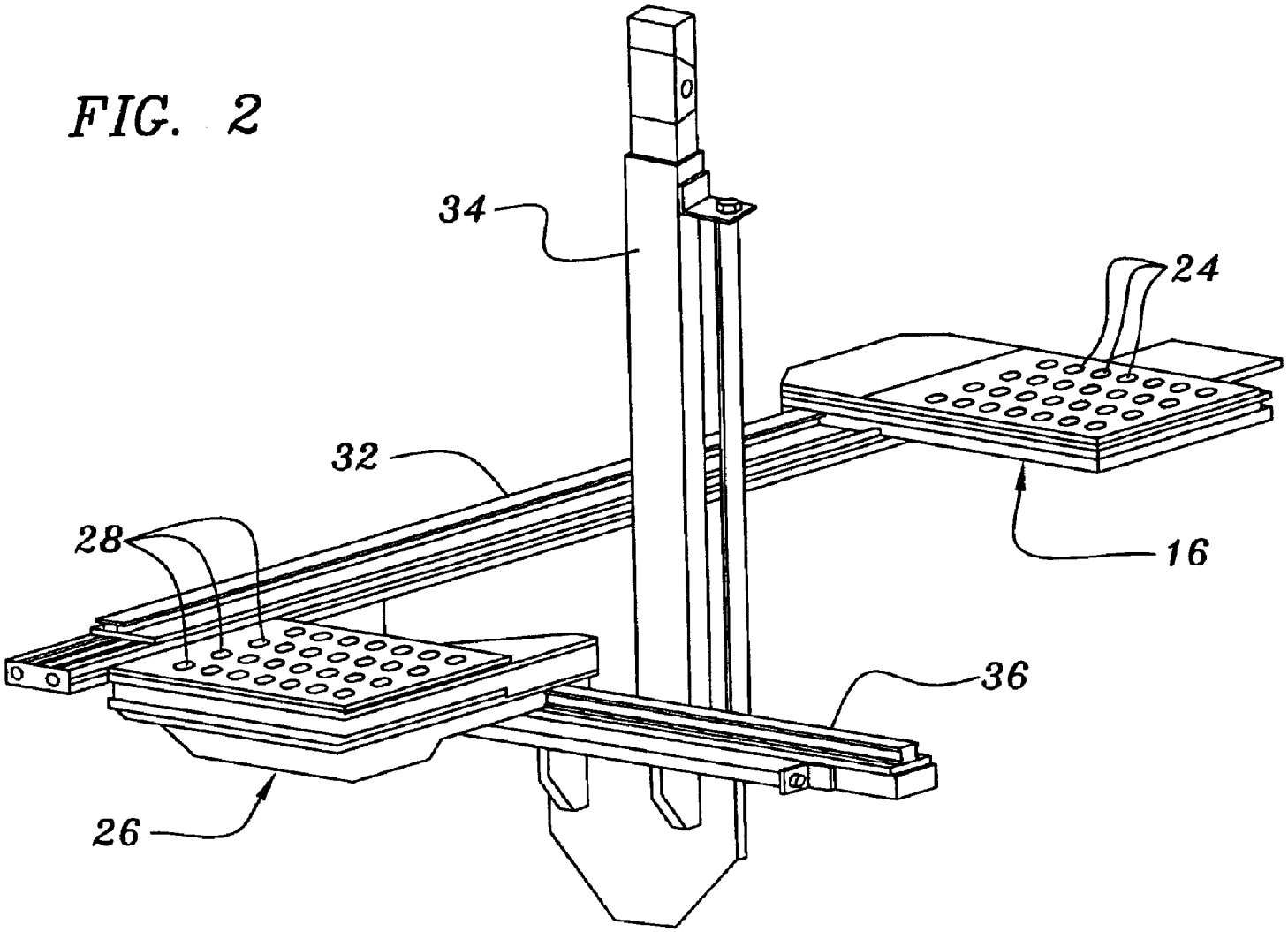
FIG. 2 illustrates a first preferred exemplary embodiment of the present invention.

FIG. 2 illustrates movement of temporary storage member 16 toward its position above the vertically displaceable temporary storage member 26. The vertically displaceable temporary storage member 26 similarly has a plurality of solid pharmaceutical product receiving cavity members 28 that may be aligned with the corresponding cavities 24 of the lower temporary storage member 16. In traversing toward the location above the vertically displaceable temporary storage member 26, the temporary storage member 16 preferably is guided along a rail 32. The mechanical displacement or drive of all devices is preferably accomplished by pneumatic drives and the like. Those skilled in the art will appreciate that a variety of alternative mechanical drives may be utilized as well, such as electric motor drives, for example. The vertically displaceable unit or temporary storage member 26 similarly is guided along a vertical rail and support 34.

Figure 3:
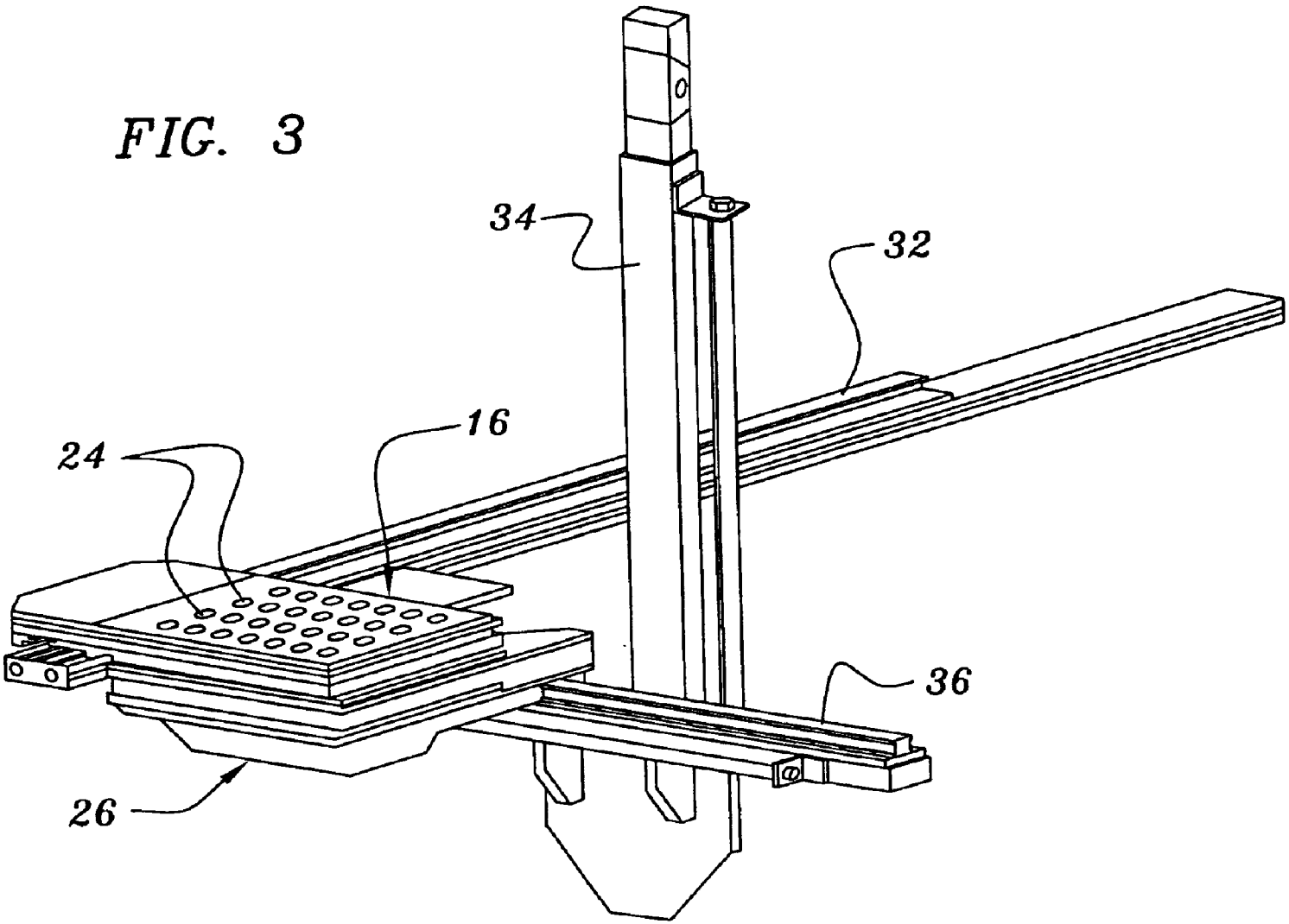
FIG. 3 illustrates a first preferred exemplary embodiment of the present invention.

FIG. 3 illustrates the stage in the processing wherein the temporary storage members 16 and 26 are in registration above one another such that each of the cavities 24 of member 16 correspond with the position of the corresponding cavities 28 in member 26. Once the cavities of the respective temporary storage members have been located with the appropriate registration of the cavities, a sliding plate located beneath the cavities in the temporary storage member 16 is displaced horizontally to expose a plurality of holes corresponding to the cavities located within the temporary storage member 16. By sliding this plate, solid pharmaceutical products located within the cavities of the temporary storage member 16 are deposited into corresponding cavities of the vertically displaceable temporary storage member 26.

Figure 4:
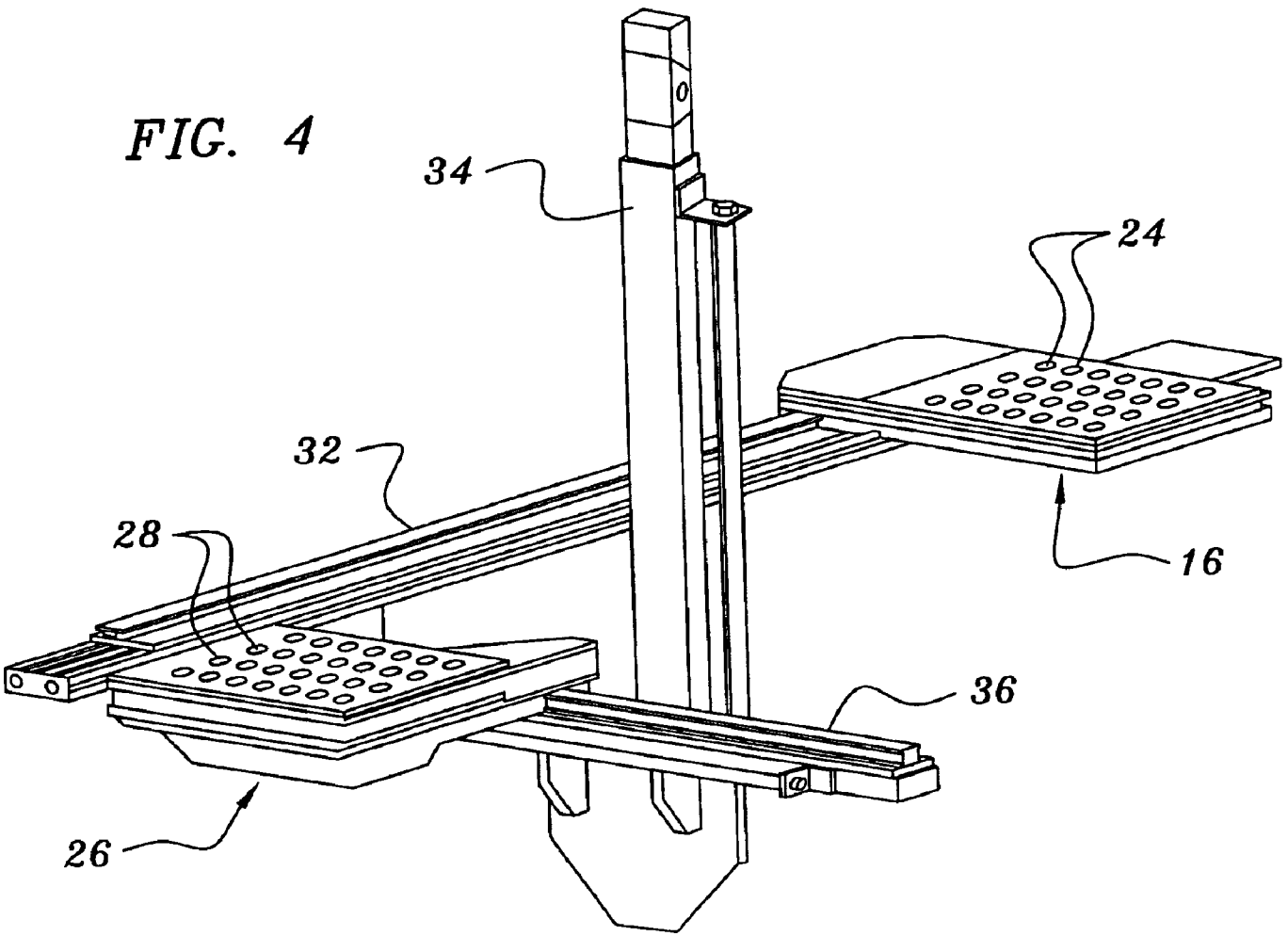
FIG. 4 illustrates a first preferred exemplary embodiment of the present invention.
Figure 5:
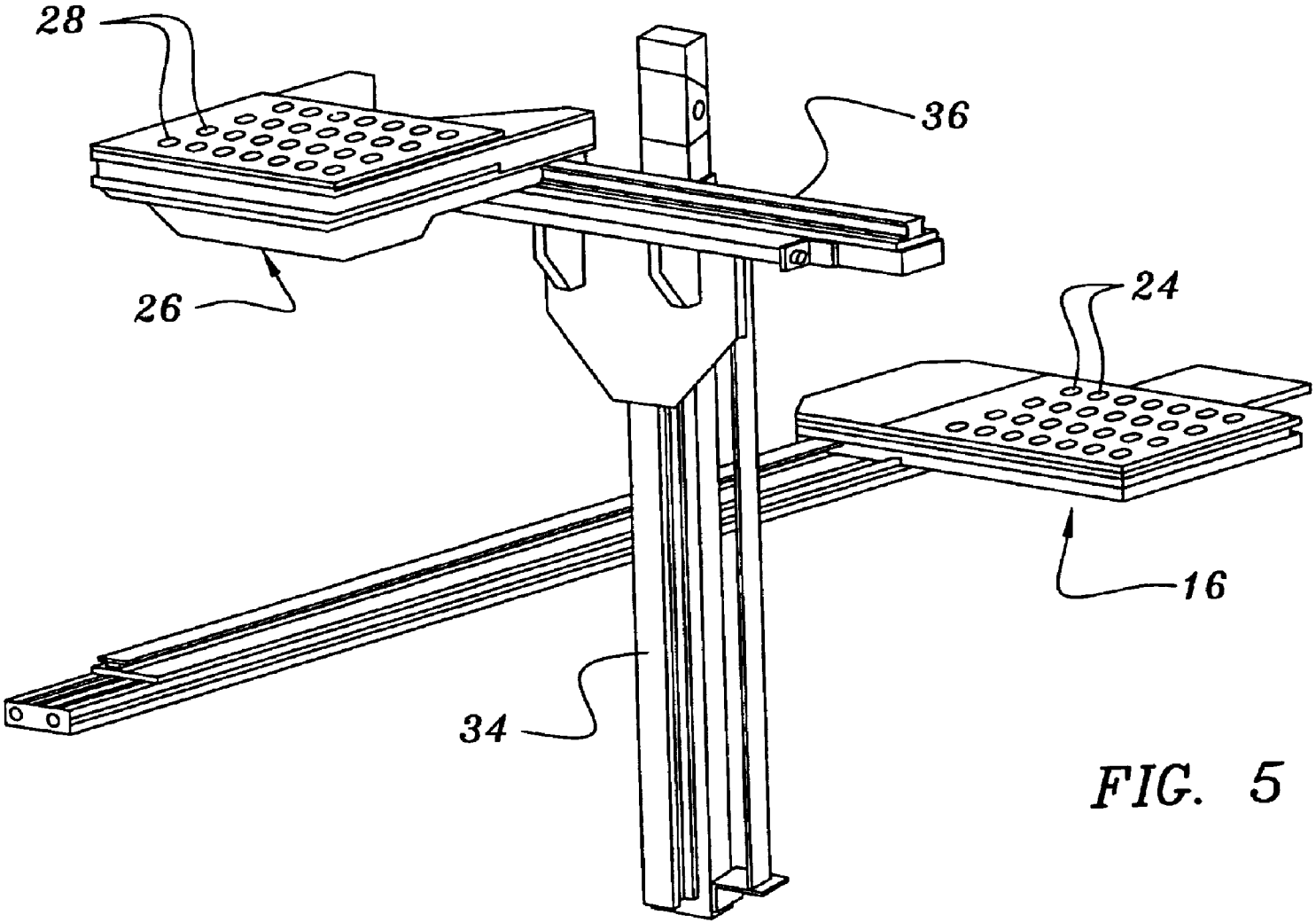
FIG. 5 illustrates a first preferred exemplary embodiment of the present invention.

The vertically displaceable member 26 moves only after the member 16 has traversed back toward its original position along rail 32. This is illustrated in FIG. 4. Thereafter, vertically displaceable temporary storage member 26 may be moved upward as illustrated in FIG. 5 for further processing. It should be noted that the vertically displaceable temporary storage member 26 is actually mounted to a horizontal rail 36 that also enables horizontal displacement of the vertically displaceable temporary storage member 26. This is preferred in order to allow the temporary storage member 26 to be selectively positioned at a filling station mounted on a table. Furthermore, this eliminates the need for additional movement of other devices due to the increased capability of this unit.

Figure 6:
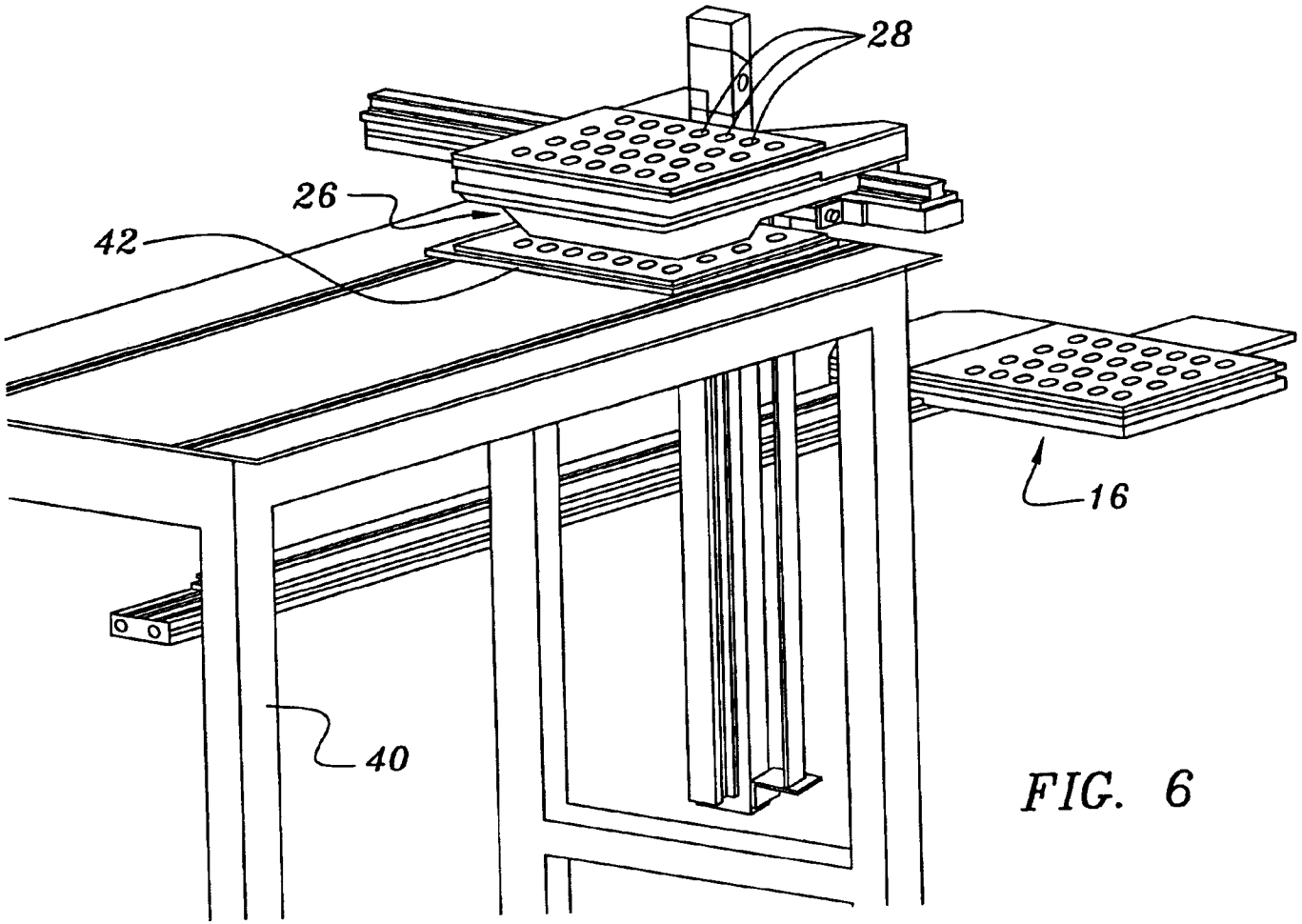
FIG. 6 illustrates a first preferred exemplary embodiment of the present invention.

FIG. 6 illustrates further processing by the packaging system after the vertically displaceable temporary storage member is positioned at the filling station secured to table 40. In particular, FIG. 6 illustrates a manual processing stage wherein an individual selectively examines each of the cavities to ensure that the appropriate medication and/or variety of medications is located in the cavities of the vertically displaceable member. Thereafter, the medications are dropped from the vertically displaceable temporary storage member 26 into the solid pharmaceutical blister packages. The medications are dropped by sliding a plate from beneath the cavities of the vertically displaceable temporary storage member 26 as is known in the art. This enables the solid pharmaceutical products to drop directly into the corresponding cavities of the blister packages which are positioned beneath the vertically displaceable temporary storage member 26.

Advantageously, the vertically displaceable temporary storage member 26 has a bottom portion that includes individual funnels which are mechanically designed to alter the drop of the individual pharmaceutical products into the desired corresponding cavities the blister packages to be filled. Those skilled in the art will appreciate that the funnel members may or may not be present depending upon whether the temporary storage member size corresponds directly to the size of the blister pack to be filled. When the blister pack is actually physically smaller than the footprint of the temporary storage member, it becomes necessary to ensure that individual mechanical guides or funnels are present to direct the solid pharmaceutical products into the desired cavities of the package. It should also be recognized that the mechanical displacement of the sliding plate that results in the drop of the solid pharmaceutical products may occur through manual intervention or automatically upon the successful registration of the vertically displaceable temporary storage member and the package to be filled.

Reference no. 42 identifies the sliding plate which receives the blister package to be filled. It is preferred that the sliding plate that causes pill drop be located above the funnel member in the lower portion of the vertically displaceable temporary storage member 26. However, those skilled in the art will appreciate that other locations for the sliding plate will also be suitable. Similarly, those skilled in the art will recognize that other modifications or alterations of the specific exemplary embodiments described herein may be made while nonetheless falling with the within the scope of the presently claimed subject matter.

I claim:

1. A solid pharmaceutical product package filling machine comprising:

a first temporary storage member for receiving a plurality of solid pharmaceutical products in a corresponding plurality of cavities;

a second temporary storage member for receiving a plurality of solid pharmaceutical products in a corresponding plurality of cavities from the first temporary storage member;

a third temporary storage member for receiving a plurality of solid pharmaceutical products in a corresponding plurality of cavities from the second temporary storage member, wherein the second storage member traverses horizontally from a location beneath the first storage member to a location above the third temporary storage member; and further wherein the third temporary storage member is automatically vertically displaceable from beneath a plane of motion of the second temporary storage member to a location above the second temporary storage member.

2. The solid pharmaceutical product package filling machine of claim 1, wherein the third temporary storage member is also capable of automatically moving in a horizontal direction.

* * * * *